United States Patent [19]

Ferrero

[11] Patent Number: 4,630,184

[45] Date of Patent: Dec. 16, 1986

[54] MOTOR VEHICLE LAMP, AND A LIGHT UNIT FOR MOTOR VEHICLES INCORPORATING SUCH LAMPS

[75] Inventor: Giorgio Ferrero, Turin, Italy

[73] Assignee: Fiat Auto S.p.A., Turin, Italy

[21] Appl. No.: 817,947

[22] PCT Filed: Apr. 15, 1985

[86] PCT No.: PCT/EP85/00166

§ 371 Date: Dec. 16, 1985

§ 102(e) Date: Dec. 16, 1985

[87] PCT Pub. No.: WO85/04944

PCT Pub. Date: Nov. 7, 1985

[30] Foreign Application Priority Data

Apr. 16, 1984 [IT] Italy ..... 67384 A/84

[51] Int. Cl.[4] ..... F21V 11/00; F21V 9/16

[52] U.S. Cl. ..... 362/351; 362/346; 362/293

[58] Field of Search ..... 362/346, 80, 348, 806, 362/351, 808, 362, 360, 311, 375, 341, 343, 293, 290, 291, 296, 297, 298, 301, 30 J, 307, 310, 300

[56] References Cited

U.S. PATENT DOCUMENTS

| | | | |
|---|---|---|---|
| 3,264,769 | 8/1966 | Harderly | 362/351 |
| 3,882,490 | 5/1975 | Tashiro et al. | 362/351 |
| 4,441,141 | 4/1984 | Lo | 362/346 |
| 4,443,832 | 4/1984 | Kanamori et al. | 362/351 |
| 4,443,835 | 4/1984 | Brautigam et al. | 362/351 |
| 4,450,513 | 5/1984 | Guggamos | 362/346 |
| 4,456,948 | 6/1984 | Brun | 362/346 |

*Primary Examiner*—Raymond A. Nelli

*Attorney, Agent, or Firm*—Sughrue, Mion, Zinn, Macpeak, and Seas

[57] ABSTRACT

In a motor vehicle lamp of the type comprising a body (2), a bulb (3) within the body (2), a transparent glass (4) having a prismatic internal surface (5) for receiving light rays emitted by the bulb (3) and focusing them outwardly in a beam having predetermined characteristics, and a colored filter (11) interposed between the bulb (3) and the transparent glass (4), the prismatic internal surface (5) of the transparent glass (4) includes diffusing lenses adapted to scatter light rays passing through the transparent glass (4) from the exterior in all directions within the body (2) of the lamp. The lamp further includes an internal reflective wall (17) for reflecting the light rays scattered within the lamp body (2) over the entire surface of the transparent glass (4), so as to prevent the colored filter (11) from being visible from the exterior when the bulb (3) is off and the lamp is illuminated from the exterior. In a first embodiment, the internal reflective wall (17) lies in a plane between the bulb (3) and the transparent glass (4) and has a central aperture (13*a*) with dimensions such as to allow the passage of only those light rays coming directly from the bulb which are incident on the surface of the transparent glass. In a second embodiment the internal reflective wall is in the form of a conical wall which surrounds the lamp bulb.

6 Claims, 8 Drawing Figures

MOTOR VEHICLE LAMP, AND A LIGHT UNIT FOR MOTOR VEHICLES INCORPORATING SUCH LAMPS

DESCRIPTION

Figure 1:
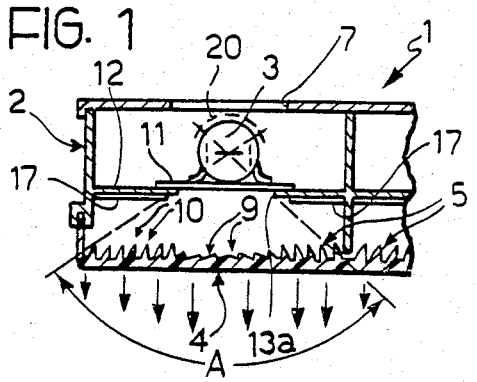

The present invention relates to motor vehicle lamps of the type comprising:

a body, a bulb within the body, a transparent glass having a prismatic internal surface for receiving light rays emitted by the bulb and focusing them outwardly into a beam having predetermined characteristics, and a coloured filter located between the bulb and the transparent glass.

Motor vehicle lamps of the type specified above have been known and used for some time (see, for example, German patent application No. 12 59 747) and allow the transparent glass of the lamp to be formed in colours different from that expected of the light from the lamp. More particularly, the transparent glass may be colourless even when the light from the lamp must be yellow or red, for example.

In lamps of this type, however, there is the problem of preventing the coloured filter within the lamp body from being visible from the exterior when the bulb is off and the lamp is illuminated from the exterior, for example by sunlight.

The object of the present invention is to provide a lamp of the type specified above, which on the one hand allows this problem to be solved and on the other hand has a relatively simple and cheap structure.

The main characteristic of the lamp according to the invention lies in the fact that the prismatic internal surface of the transparent glass includes diffusing lenses for scattering light rays passing through the transparent glass from the exterior in all directions within the body of the lamp, and in that the lamp further includes an internal reflective wall for reflecting the light rays scattered within the body of the lamp over the entire internal surface of the transparent glass, so as to prevent the coloured filter from being visible from the exterior when the bulb is off and the lamp is illuminated from the exterior. In this condition, the transparent glass takes on a colour corresponding to that of the internal reflective wall. It is thus possible, in sunlight, to make the glass take on the appearance of a desired colour (for example, the colour of the adjacent part of the motor vehicle bodywork) or to keep its colourless appearence.

In a first embodiment, the internal reflective wall is located between the bulb and the transparent glass and has a central aperture of such a size as to allow the passage of only those light rays coming directly from the bulb which are incident on the surface of the transparent glass.

In a second embodiment, the internal reflective wall is instead in the form of a conical surface surrounding the light bulb.

In the case of the first embodiment, a liquid crystal element is preferably located between the internal reflective wall and the transparent glass, which can be switched between two operating states in which the liquid crystals are substantially transparent and substantially opaque, respectively.

By virture of this characteristic it is possible, when the bulb is on and the lamp is illuminated from the exterior (for example by the headlights of a following motor vehicle), to prevent the internal reflective wall from reflecting the light rays entering the lamp from the exterior and altering the characteristics of the beam emitted by the lamp.

The same problem is avoided in the second embodiment by the provision of a reflector between the internal reflective wall and the transparent glass, which has a prismatic surface for reflecting light rays from the bulb to the exterior and for refracting light rays from the exterior of the lamp, with the exception of light rays coming from the exterior in a direction substantially parallel to the optical axis of the lamp, onto the internal reflective wall.

The invention also provides a light unit for motor vehicles, characterised in that it includes several lamps of the type specified above, having the body and the transparent glass in common.

Figure 2:
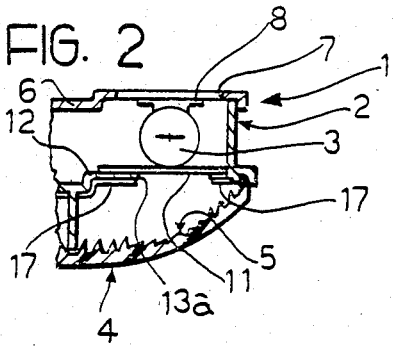
Figure 3:
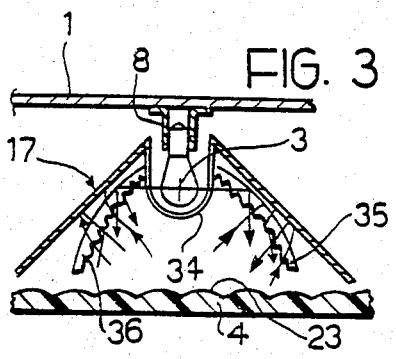
Figure 4:
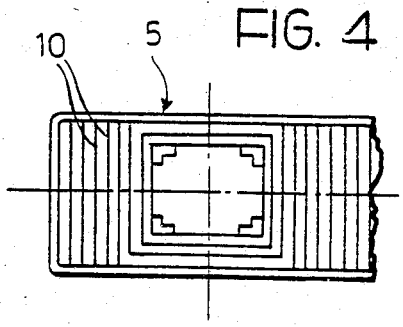
Figure 6:
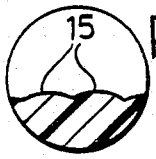
Figure 7:
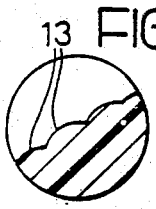
Figure 8:
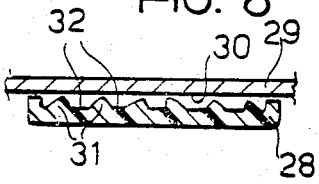
Figure 5:
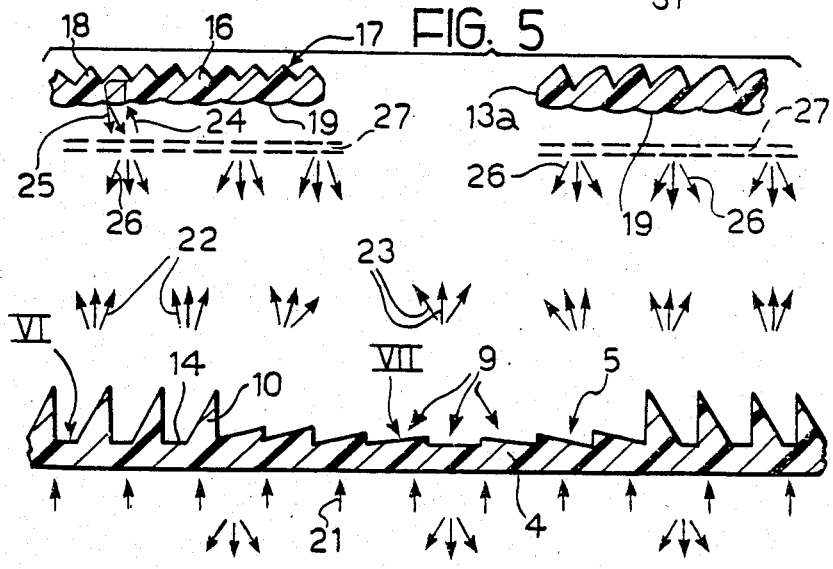

Further characteristics and advantages of the present invention will become apparent from the description which follows with reference to the appended drawings, provided purely by way of non-limiting example, in which:

FIG. 1 is a sectional view in a horizontal plane of a first embodiment of the lamp according to the present invention, FIG. 2 illustrates a variant of FIG. 1, FIG. 3 is a sectional view in a horizontal plane of a second embodiment of the lamp according to the present invention, FIG. 4 is a frontal view of the internal surface of the transparent glass forming part of the lamp of FIG. 1, FIG. 5 illustrates a detail of FIG. 1 on an enlarged scale, FIGS. 6 and 7 illustrate the details indicated by the arrows VI and VII in FIG. 5 on an enlarged scale, and FIG. 8 is a sectional view in a horizontal plance of a reflex reflector forming part of a rear light unit for motor vehicles, including a lamp according to the present invention.

With reference to FIG. 1, a motor vehicle lamp, generally indicated 1, comprises a body 2, for example of plastics material, a bulb 3 located within the body 2, and a transparent glass 4 also of plastics material and has, in known manner, a prismatic internal surface 5 for receiving light rays emitted by the bulb 3 and focusing them outwardly into a beam having predetermined characteristics.

In the embodiment illustrated in FIG. 1, the body 2 of the lamp has, on its side opposite the transparent glass 4, a cover 6 with an aperture 7 for allowing illumination of the vehicle luggage compartment. A bulb holder, indicated 8, may be fixed to the body 2 as in the example of FIG. 1, or to the cover 6 as in the example of FIG. 2.

It should be noted that the lamp illustrated in FIG. 2 has exactly the same structure as the light of FIG. 1 and differs therefrom solely in the shape of its various components. Furthermore, the two lamps illustrated in FIGS. 1 and 2 may form part of a single rear light unit for motor vehicles, in which the lamp of FIG. 1 corresponds, for example, to the tail light of the vehicle and the lamp of FIG. 2 serves as a direction indicator. Similarly, the same light unit may have a reversing light with a structure similar to those illustrated in FIGS. 1 and 2. Clearly, in the case of a single light unit, the transparent glass of the various lamps is constituted by a single element of plastics material, which has a prismatic surface 4 on its inner face in correspondence with each lamp in order to form a beam of predetermined characteristics.

This prismatic surface formed on the inner face of the transparent glass in correspondence with each lamp has, in known manner, a central zone of refracting prisms 9 and a peripheral zone of totally reflecting prisms 10.

Between the bulb 3 of each lamp and the transparent glass 4 is a coloured filter 11, for example of glass or plastics material. The coloured filter 11 may be flat as illustrated in FIGS. 1 and 2, or in the form of cap.

The body 2 of the lamp includes a wall 12 located between the bulb 3 and the transparent glass 4. The wall 12 has an aperture 13*a* for allowing the passage of light from the bulb 3 which is coloured by the filter 11 and is directly incident on the inner surface of the transparent glass 4. As is clear from FIG. 1, the light rays outside the solid angle A through which the transparent glass 4 is visible from the centre of the bulb 3 do not pass through the aperture 13*a*.

The use of the coloured filter 11 allows the use of a colourless transparent glass 4 even when the light emitted by the lamp must have a particular colour, for example red or yellow.

As mentioned in the introduction to the present specification, it is difficult to prevent the coloured filter 11 from being visible from the exterior when the bulb 3 is off and the lamp is illuminated from the exterior, for example by sunlight. This problem is solved in the lamp according to the present invention in the following manner.

With reference to FIGS. 5 to 7, those surface portions of the refracting prisms 9 which are not perpendicular to the general plane of the transparent glass 4 are shaped so as to define a series of diffusing lenses 13.

Similarly, the peripheral zone of the prismatic surface 5 includes flat zones 14 interposed between the totally reflecting prisms 10 and shaped so as to define a plurality of diffusing lenses 15 (see FIG. 6).

FIG. 4 illustrates, by way of example, a frontal view of the internal surface of the transparent glass 4 with reference to the case in which the prisms 10 are disposed in concentric rings. Naturally, all the prisms 10 could also be arranged in the same direction, for example horizontally or vertically.

In correspondence with the surface of the wall 12 facing the transparent glass 4 there is an internal reflective wall 16, illustrated on an enlarged scale in FIG. 5. In the embodiment illustrated in this drawing, the wall 16 is essentially in the form of a reflex reflector. It has one surface facing in the opposite direction from the transparent glass 4, which is constituted by a prismatic surface 17 comprising a series of trihedral prisms 18 with right vertices. The wall 17 has a series of diffusing lenses 19 on its surface facing the transparent glass 4. Consequently, the element 17 behaves as an imperfect reflex reflector. This means that it reflects light rays from the exterior of the lamp which are incident on its surface facing the transparent glass 4 in the opposite direction from which they come but with a certain degree of scattering of the light, as will be explained in detail below.

The diffusing lenses 19 may be cylindrical or spherical lenses. Although the reflective wall 17 is shown in the appended drawings as a flat element, this wall could also be concave, for example conical, as will be explained with reference to the embodiment of FIG. 3.

Moreover, FIG. 5 relates to an embodiment in which the reflective wall 17 is constituted by an element of plastics material intended to be fixed to the wall 12 of the lamp body.

It is possible, however, to form the element 17 as a layer of shiny or metallised coloured varnish (with microprisms in the form of pyramids with right vertices). It is also possible to mould the wall 12 of the lamp body from a coloured plastics material so that the wall can act as a reflective element. A further possibility is to provide for the use of a sheet of transparent plastics material of the colour which it is desired to impart to the transparent glass when the bulb is off and having a prismatic surface (with pyramidal prisms with right vertices) made on its rear face by coining.

In the drawings, a reflective screen for reflecting some of the light directed to the rear part of the lamp towards the transparent glass 4 is indicated 20.

The operation of the lamp described above is as follows:

When the bulb 3 is lit, the light from the bulb is coloured by the filter 11 and then focused by the prismatic surface 5 of the transparent glass 4 into a beam having the desired characteristics. As already mentioned above, the presence of the coloured filter means that the transparent glass 4 can be colourless.

When the bulb 3 is off and the lamp is illuminated from the exterior, the coloured filter 11 is not visible from the exterior since the light (for example sunlight) which enters the lamp is reflected from the element 17 and scattered over the entire surface of the transparent glass. The light from the exterior which is incident on the coloured filter 11 passes therethrough and is dispersed in the rear part of the lamp.

In FIG. 5, light rays 21 are shown, by way of reference, which are directed parallel to the optical axis of the lamp. In passing through the transparent glass 4, the rays 21 are scattered by the diffusing lenses 13 and 15 (see FIGS. 6 and 7). In FIG. 5 the light rays diffused respectively by the lenses 15 and the lenses 13 are indicated 22 and 23.

Still with reference to FIG. 5, a light ray 24 which is incident on the reflective wall 17 is reflected by the prisms on the rear surface of this wall and then scattered by the lenses 19 into a series of rays 25. In FIG. 5 the light rays reflected by the wall 17 are indicated 26. As illustrated, these light rays are scattered in various directions towards the transparent glass 4. Hence, the rays can be reflected by the wall 17 over the entire surface of the glass 4. When the bulb is off and the lamp is illuminated from the exterior, for example by sunlight, the transparent glass, although being colourless, takes on the colour of the reflecting element A. It is thus possible to make the transparent glass assume, for example, the colour of the bodywork part (or bumper) adjacent thereto.

According to a further preferred characteristic of the invention, the lamp has a liquid crystal element 27 in correspondence with the reflective wall 17, which can be switched between two operating states in which the liquid crystals are substantially transparent and substantially opaque, respectively. The electrical signal for switching the liquid crystals from the transparent state to the opaque state is generated at the moment when the lamp bulb is lit. Thus, when the bulb is lit, the light coming from the exterior (for example, from the headlights of a following motor vehicle) cannot be reflected from the element 17 (because the light is incident on the opaque liquid crystals) whereby it is impossible for the characteristics of the beam emitted by the lamp to be altered as a result of the light entering the lamp being reflected by the element 17. The presence of the liquid crystal element 27 allows the reflective wall 17 to be made even with a strong colour since the disadvantage mentioned above is completely eliminated.

According to one possible variant, the elements 17 and 27 may be formed from one coloured reflective film including a layer of liquid crystals. The film can be cut to the desired shape and may be flat or conical.

In the case of a light unit comprising several lamps of the type described above (see FIGS. 1 and 2) a transparent glass may be formed in one colour or so as to include different zones of desired colours in correspondence with the various lamps. Preferably, the light unit further includes a reflex reflector of the type illustrated in FIG. 7, having a dark, almost black appearance in sunlight. This reflex reflector is constituted by an element 28 moulded from plastics material of a red colour and fixed to a wall 29 having a black surface 30. One part of the internal surface of the reflector 28 has conventional prisms 31, while the remaining part is constituted by a series of flat surfaces 32 parallel to the external surface and distributed on horizontal, vertical or inclined lines.

FIG. 3 illustrates a second embodiment of the lamp according to the present invention, in which the transparent glass 4 has a surface with diffusing lenses 33 while the reflective wall 17 is conical and surrounds the bulb 3. The light from the bulb is focused into a beam of predetermined characteristics by a reflector 35 of transparent plastics material having a prismatic surface 36.

The light from the exterior which enters the lamp is refracted (with the exception of that directed parallel to the optical axis of the lamp) onto the reflective element 17, which operates in a similar manner to that described with reference to FIG. 5. The prismatic surface of the reflector 35 is shaped so as to prevent the passage of light parallel to the optical axis of the lamp, however, so that the colour of the element 17 is not visible in this direction. From all other directions, however, the colour is visible since, as already mentioned, the reflector 35 then becomes a refractor. Hence, in the case of the embodiment of FIG. 3, it is not necessary to provide a liquid crystal element. Indeed, when the bulb is lit, the emitted beam is relatively narrow about the optical axis and it is impossible for the colour of the element 17 to alter in the characteristics of this beam. At the same time, when the lamp is observed from the exterior in sunlight, this observation is effected only in random directions different from that of the optical axis of the lamp.

Naturally, the principle of the invention remaining the same, the constructional details and embodiments may be varied widely with respect to that described and illustrated purely by way of example, without thereby departing from the scope of the present invention.

I claim:

1. Motor vehicle lamp comprising a body (2), a bulb (3) within the body (2), a transparent glass (4) having a prismatic internal surface (5) for received light rays emitted by the bulb (3) and focusing them outwardly into a beam having predetermined characteristics, a coloured filter (11) located between the bulb (3) and the transparent glass (4), characterised in that the prismatic internal surface (5) of the transparent glass (4) includes diffusing lenses (13, 15) for scattering light rays passing through the transparent glass (4) from the exterior in all directions within the body (2) of the lamp, and in that the lamp further includes an internal reflective wall (17) for reflecting the light rays scattered within the body (1) of the lamp over the entire internal surface (5) of the transparent glass (4), so as to prevent the coloured filter (11) from being visible from the exterior when the bulb (3) is off and the lamp is illuminated from the exterior.

2. Lamp according to claim 1, characterised in that the internal reflective wall (17) is interposed between the bulb (3) and the transparent glass (4) and has a central aperture (13*a*) of such a size as to allow the passage of only those light rays coming directly from the bulb (3) which are incident on the surface of the transparent glass (4), whereby to allow the direct illumination of the glass and leave the remaining internal walls of the lamp in shadow.

3. Lamp according to claim 1, characterised in that the internal reflective wall (17) is in the form of a conical wall surrounding the bulb (3).

4. Lamp according to claim 2, characterised in that the reflective wall (17) has a series of diffusing lenses (19) on its surface facing the transparent glass (4), and a prismatic surface (18) on its opposite face.

5. Lamp according to claim 2, characterised in that a liquid crystal element (27) is located between the internal reflective wall (17) and the transparent glass (4), which can be switched between two operating states in which the liquid crystals are substantially transparent and substantially opaque, respectively.

6. Lamp according to claim 3, characterised in that a reflector (35) is located between the internal reflective wall (17) and the transparent glass (4), which has a prismatic surface for reflecting light rays from the bulb (3) to the exterior and for refracting light rays coming from the exterior of the lamp, with the exception of light rays coming from the exterior in a direction substantially parallel to the optical axis of the lamp, onto the internal reflective wall (17).

* * * * *